US005148800A

United States Patent [19]

Pecheux

[11] Patent Number: 5,148,800

[45] Date of Patent: Sep. 22, 1992

[54] APPARATUS FOR THE CONTINUOUS PASSIVE ARTICULATORY MOBILIZATION OF THE FOOT OF NEW-BORN BABY OR CHILD TECHNICAL DOMAIN

[76] Inventor: Jean-Claude Pecheux, 100bis, rue de Saint-Quentin, Aiglemont - 08000 Charleville Mezieres, France, 08000

[21] Appl. No.: 613,650

[22] PCT Filed: Mar. 29, 1990

[86] PCT No.: PCT/FR90/00219

§ 371 Date: Nov. 30, 1990

§ 102(e) Date: Nov. 30, 1990

[87] PCT Pub. No.: WO90/11750

PCT Pub. Date: Oct. 18, 1990

[30] Foreign Application Priority Data

Mar. 30, 1989 [FR] France ..... 8904443

[51] Int. Cl.[5] ..... A61H 1/02

[52] U.S. Cl. ..... 128/25 B; 482/79; 128/25 R

[58] Field of Search ..... 128/26, 44, 45, 48, 128/49, 51, 52, 25 R, 25 B; 272/96; 482/79

[56] References Cited

U.S. PATENT DOCUMENTS

| | | | |
|---|---|---|---|
| 2,206,902 | 7/1940 | Kost | 128/25 B |
| 2,216,764 | 10/1940 | Clark | 128/25 B |
| 2,397,428 | 3/1946 | Moshier . | |
| 2,591,212 | 4/1952 | Stauffer . | |
| 4,199,137 | 4/1980 | Giguére | 128/25 B X |
| 4,306,714 | 12/1981 | Loomis et al. . | |
| 4,337,939 | 7/1982 | Hoyle et al. . | |
| 4,452,447 | 6/1984 | Lepley et al. . | |
| 4,650,183 | 3/1987 | McIntyre | 128/25 B X |
| 4,733,859 | 3/1988 | Kock et al. | 128/25 B X |
| 4,767,118 | 8/1988 | Ostergard . | |
| 4,807,874 | 2/1989 | Little . | |
| 4,842,265 | 6/1989 | Kirk | 128/25 B |
| 4,862,875 | 9/1989 | Heaton | 128/25 B |

FOREIGN PATENT DOCUMENTS

| | | | |
|---|---|---|---|
| 2226982 | 11/1974 | France . | |
| 2635457 | 2/1990 | France . | |
| 725666 | 4/1980 | U.S.S.R. | 128/25 B |

OTHER PUBLICATIONS

"Bowen Fractive Appliances" Advertisement; *Journal of Bone & Joint Surgery,* vol. 46-A, #3, Apr. 1964.

*Primary Examiner*—Richard J. Apley
*Assistant Examiner*—Linda C. M. Dvorak
*Attorney, Agent, or Firm*—Bacon & Thomas

[57] ABSTRACT

A foot mobilization apparatus is arranged to permit independently adjustable, motor driven, pivotal movement of one or both feet relative to their three articulatory axes.

10 Claims, 10 Drawing Sheets

A
C'
C'
C'
IB
IB
IB'
IB'
C
C
x
x'
y
$I_a$
$I_b$
1a
2a
3a
4a
5a
6a
7a
8a
31a
34a
38
1b
2b
3b
4b
5b
6b
7b
8b
9
10
11
12
13
16
17
31b
34b
36b

APPARATUS FOR THE CONTINUOUS PASSIVE ARTICULATORY MOBILIZATION OF THE FOOT OF NEW-BORN BABY OR CHILD TECHNICAL DOMAIN

The invention relates to the technical domain of articulatory mobilization, with a view to the orthopaedic correction of the foot in the new-born baby and the child.

The apparatus makes it possible to mobilize a foot or the two feet, simultaneously, in the three perpendicular planes in space.

The definition of the movements of the body and of those of the foot is conventionally effected with respect to three perpendicular planes in space, which are illustrated in FIG. 1. It is question of:

the sagittal or median antero-posterior plane (S), the frontal plane (F), and the horizontal transverse plane (T).

These three planes determine three axes of mobilization A—A', B—B- and C—C' which may be related to the articulations of the foot, as is known in FIG. 2.

Axis A—A' is that of the dorsal flexion-plantar flexion of the foot, as schematically shown in FIG. 3. The flexion is called dorsal when the dorsal face of the foot approaches the anterior face of the leg. The flexion is called plantar when the dorsal face of the foot moves away from the anterior face of the leg. The foot is then called in equinus.

Axis B—B' is that of the supination-pronation or varus-valgus, as shown in FIG. 4. The foot is called in varus or supination when the sole of the foot faces the median axis of the body. The foot is called in valgus or pronation when the sole of the foot faces laterally.

Axis C—C' is that of abduction-adduction, illustrated in FIG. 5. The foot is called in adduction when its antero-posterior longitudinal axis is directed towards the median axis of the body. The foot is called in abduction when its longitudinal axis moves away from the median plane of the body.

Anatomical malformations of the foot are frequently encountered, particularly talipes equinus, i.e. naturally adopting a position in adduction, in varus and in equinus. Such combined malformations are, in 50% of the cases, bilateral. It is considered that such malformations may be corrected, at least partly, by continuous passive articulatory mobilization.

PRIOR ART

A so-called mechano-therapy apparatus is known which allows active or active-passive mobilization of the foot in the three perpendicular axes in space. This so-called Franco apparatus does not come within the framework of the continuous passive articulatory mobilization.

Apparatus for positioning the foot with a view to orthopaedic correction are known. Such apparatus do not come within the scope of continuous passive articulatory mobilization either.

Apparatus for continuous passive mobilization of the foot are also known. Such so-called Mobilimb apparatus, marketed by the firm TORONTO MEDICAL Co., mobilize the foot only in dorsal flexion-plantar flexion.

Finally, Patent Application FR 88-09701 discloses an apparatus for continuous passive mobilization of the foot on the three axes A—A', B—B' and C—C' This apparatus makes it possible to mobilize only one foot at a time. Simultaneous treatment, symmetrical or not, of the two feet is therefore excluded.

The second drawback presented by this apparatus resides in the fact that, the second foot not being connected during the correction phase of the first, the child conserves the possibility of effecting movements of rotation or creep which risk cancelling the desired orthopaedic correction.

The object of the invention is to overcome the above drawbacks by proposing a novel apparatus designed to fill in the gaps of the existing apparatus and to allow, on the contrary, the mobilization equally well of one foot or of the two feet simultaneously.

One of the objects of the present invention is to offer a mobilization apparatus making it possible, in the case of one foot having to be mobilized, to conserve the other foot connected to the apparatus, whatever the movements of the child, and enabling the lower limbs to be placed in a symmetrical position allowing a correcting mobilization.

The apparatus according to the invention is, in addition, designed so that it may either be placed on a base or be suspended. In the latter case, the child may effect active movements of flexion-extension of the lower limbs, which allows his/her muscular system to be maintained or developed.

STATEMENT OF THE INVENTION

To attain the above objects, the apparatus is characterized in that it comprises at least one mobilization assembly in which:

- the sole is mounted around an axis of flexion on the first support constituted by a plate itself mounted on the second support by an abduction-adduction pivot,
- the second support is constituted by a beam mounted around a varus-valgus axis of articulation on an arm extending laterally with respect to a cradle mounted in articulated manner on a support console,
- the operating system includes:
  - a driving member mounted on the cradle and capable of being driven in alternate, partial, angular rotations,
  - a device for converting the rotary movement of the driving member into a reciprocating rectilinear movement,
  - and means for rigid connection, of adjustable length, between the device for movement conversion and at least the second support and an extension of the plate.

Various other characteristics will appear from the following description made with reference to the accompanying drawings which show, by way of nonlimiting examples, embodiments of the object of the invention.

BEST MANNER OF EMBODYING THE INVENTION

Figure 2:
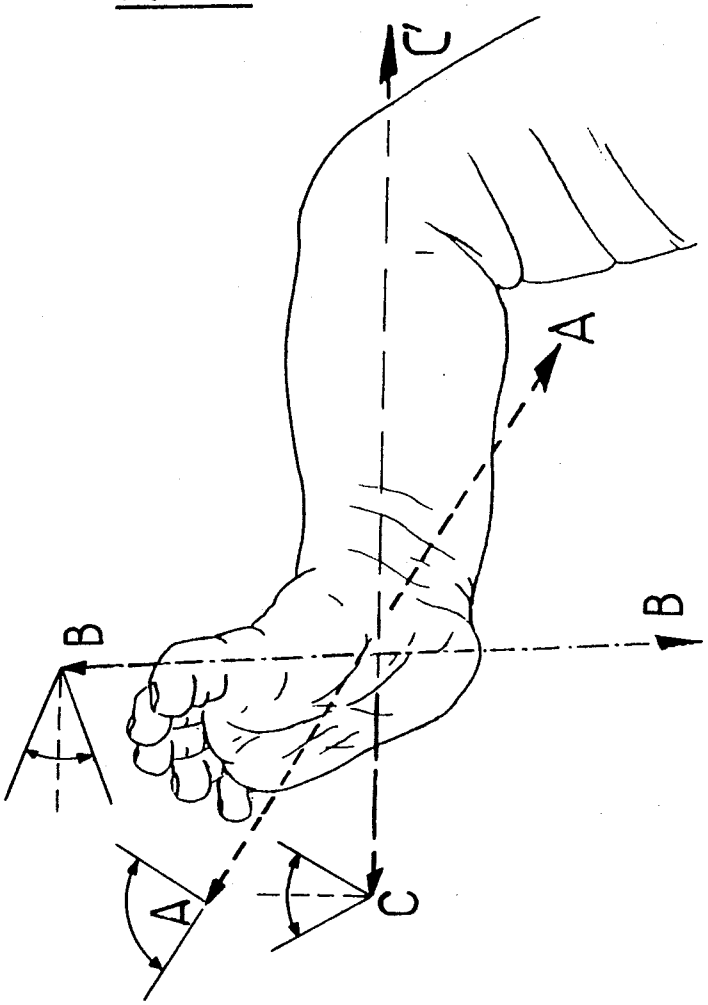
FIGS. 1 to 5 are schematic views showing the different spatial references with respect to which the movements of the human body and, more particularly, of the foot, are effected.
Figure 1:
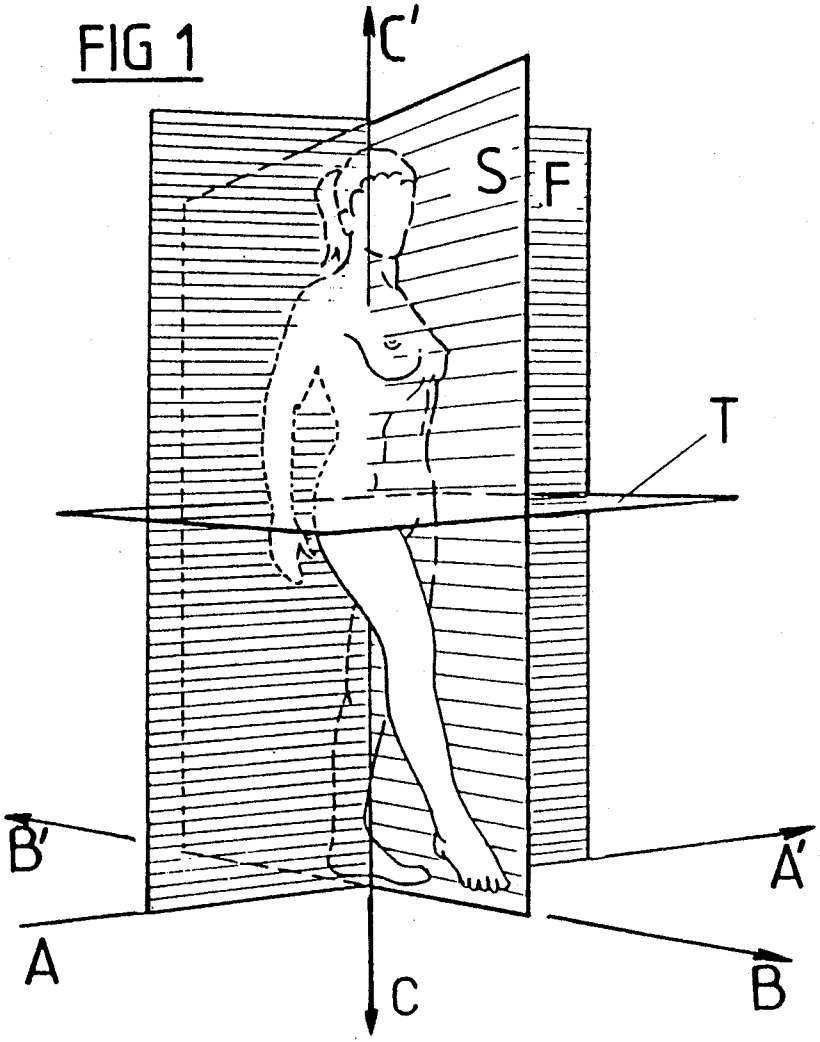
Figure 3:
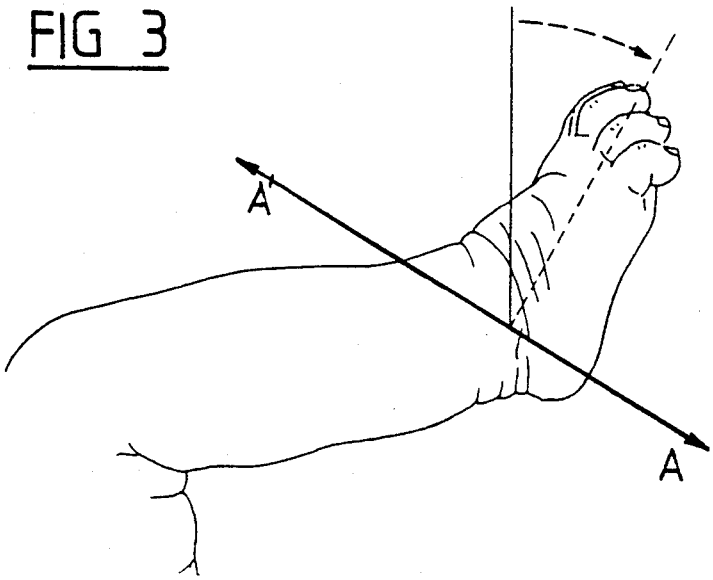
Figure 4:
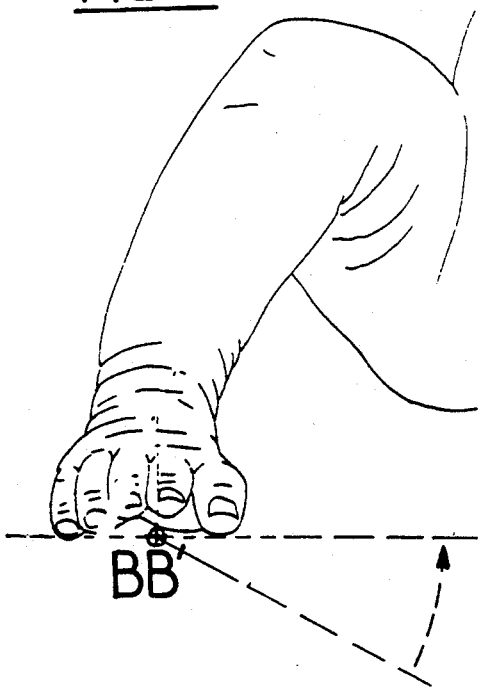
Figure 5:
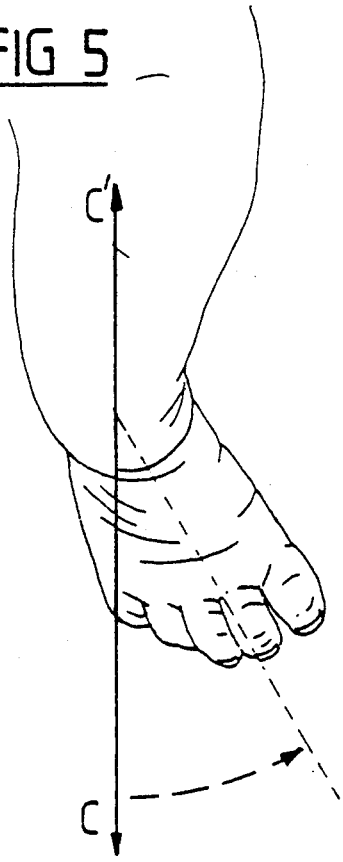
Figure 6:
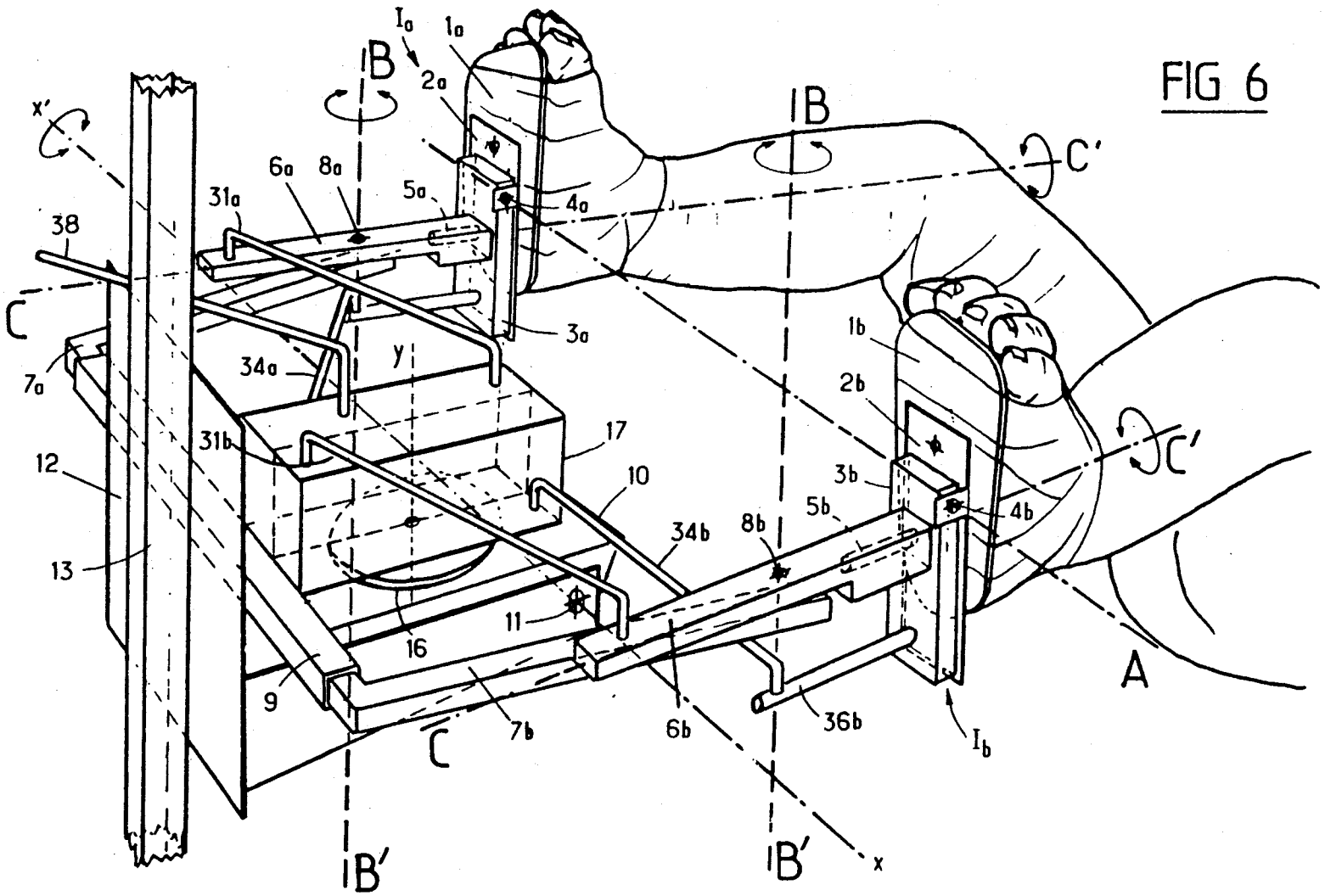
FIG. 6 is a perspective overall view of the apparatus according to the invention.

The apparatus according to the invention, as illustrated in FIGS. 6 to 10, is composed of two articulated assemblies 1*a* and 1*b*, respectively right-and left-hand. The two assemblies 1*a* and 1*b* are disposed symmetrically on either side and at equi-distance from the sagittal plane S. Each assembly comprises the same members designated by the same references given indices a and b in the drawings. Each assembly comprises a sole 1 which is orientable, on the one hand, along an inherent axis A—A' of dorsal flexion-plantar flexion and, on the other hand, along a likewise inherent axis C—C' of abduction-adduction.

The sole 1 is mounted on a sole-holder by means of an anti-rotation catch and a fixation means 2. The sole-holder is articulated on a first support 3, constituted by a plate, by means of a blockable pin 4 materializing the geometrical axis A—A'. The plate 3 is mounted by a pivot 5, materializing the geometrical axis C—C', on a second support 6 constituted by a beam extending perpendicularly to the plane of the plate. The beam 6 is mounted on an arm 7 by a pin 8 materializing the geometrical axis B—B' of supination-pronation. The arm 7 is mounted to be telescopically adjustable in a tubular member 9 common to the two arms and extending parallel to the axes A—A'. The member 9 is borne by a cradle 10 mounted by two coaxial pivots 11 on a console 12 borne by a bracket 13 forming part of an assembly structure comprising a support base or a suspension member. The pivots 11 materialize a geometrical pivoting axis x parallel to axes A—A' and located between these latter and the member 9.

The cradle 10 supports an operating system in concomittant, alternate, partial, angular pivotings of assemblies 1*a* and 1*b*. The operating system comprises a driving member capable of being driven in alternate, partial, angular rotations. This driving member is constituted by an electric motor 14 with double direction of rotation, associated with a reading potentiometer or with an angular position coder. The motor 14 is mounted on the cradle 10 and bears, by its driven shaft, a toothed pinion 15 permanently meshing with a toothed wheel 16 rotating on an axis Y and with which it forms a speed reducing gear train.

The operating system also comprises a device for converting the movement of partial, angular rotation of the driving member into a reciprocating rectilinear movement. This conversion device is composed of a support 17 fast with the wheel 16 and on which are mounted, in two superposed stages, two pairs 18*a*-18*b* and 19*a*-19*b* of rods at least partly threaded and each capable of being controlled in rotation by a knob 20. Rods 18*a*-18*b* and 19*a*-19*b* extend parallel to one another, on either side of axis y, also being disposed on either side of said axis in each pair. Rods 18*a*-18*b* and 19*a*-19*b* each support a tapped slide 21*a*-21*b* and 22*a*-22*b* of which the axial position may be adjusted by rotation of the corresponding rod by means of the knob 20. From the support 17 there also rises a column 23 extending parallel to axis y, being offset radially with respect to the latter. The column 23 supports, on a stage superposed on those of the pairs of rods, a threaded rod 24 occupying a direction orthogonal to those of the pairs of rods. Rod 24 may be controlled in rotation by a knob 25 and bears a tapped slide 26. The support 17 further comprises an index 27 intended to cooperate with a graduated scale 28 presented by the cradle 10 and presenting a marked range of graduations on either side of a zero position.

The slides 21*a* and 21*b* are initially mounted on rods 18*a* and 18*b* so as to be located in opposition on either side of axis Y. Slides 21*a* and 21*b* are joined by articulations 30*a*-30*b* to connecting rods 31*a*-31*b* fitted by adjusting blocks 32*a* and 32*b* on the beams 6*a* and 6*b*. An inversely symmetrical arrangement is adopted for the position of the slides 22*a* and 22*b* on the rods 19*a* and 19*b*. The slides 22*a* and 22*b* are joined by articulations 33*a* and 33*b* to connecting rods 34*a* and 34*b* which are fitted by adjusting blocks 35*a* and 35*b* on extensions 36*a* and 36*b* fast with the plates 3*a* and 3*b*. The slide 26 is joined by an articulation 37 to a connecting rod 38 fitted, by an articulated adjusting block 39, on the console 12.

Figure 7:
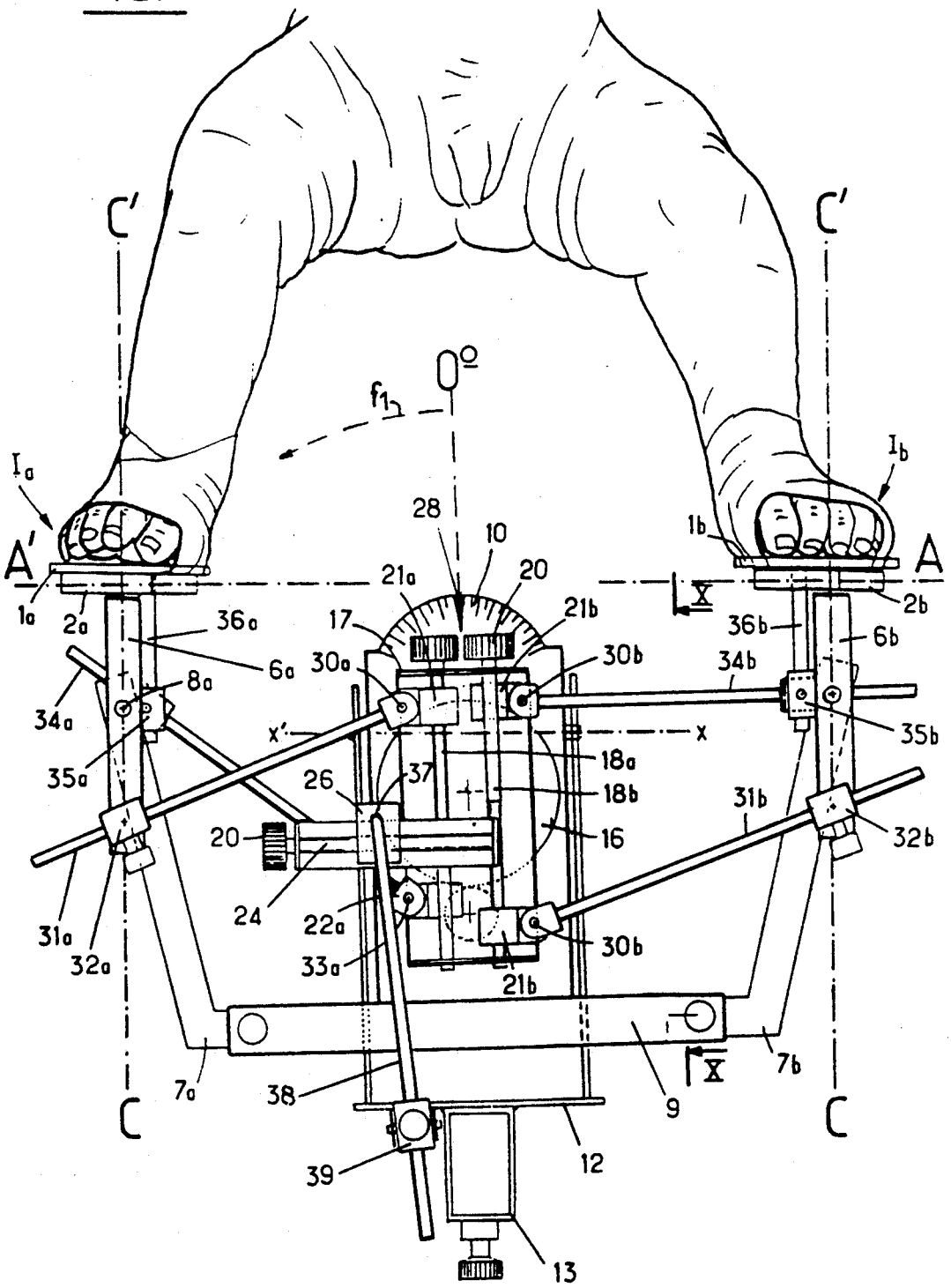
FIG. 7 is a plan view of the apparatus according to FIG. 6.

The apparatus described hereinabove operates in the following manner:

The patient having to be mobilized is presented, as illustrated in FIG. 7, for example flat on his/her back, so as to guide the feet on the soles 11 on which they are fitted by binding. The different slides 21*a*, 21*b* and 22*a*, 22*b* and 26 are brought into extreme radial position, via knobs 20, then the corresponding blocks 32*a*, 32*b* and 35*a*, 35*b* and 39 are unblocked. The telescopic arms 7 are then adjusted in relative spaced apart relationship, so as to place the soles 1 in the position of presentation adapted to the size and morphology of the patient. Blocks 32*a*, 32*b*, 35*a*, 35*b* and 39 are then blocked.

The above adaptation, necessary as a function of the patient to be mobilized, is effected in a neutral position of the operating system maintaining the box 17 in reference of alignment by its index 27 with the zero of the scale 28.

Figure 11:
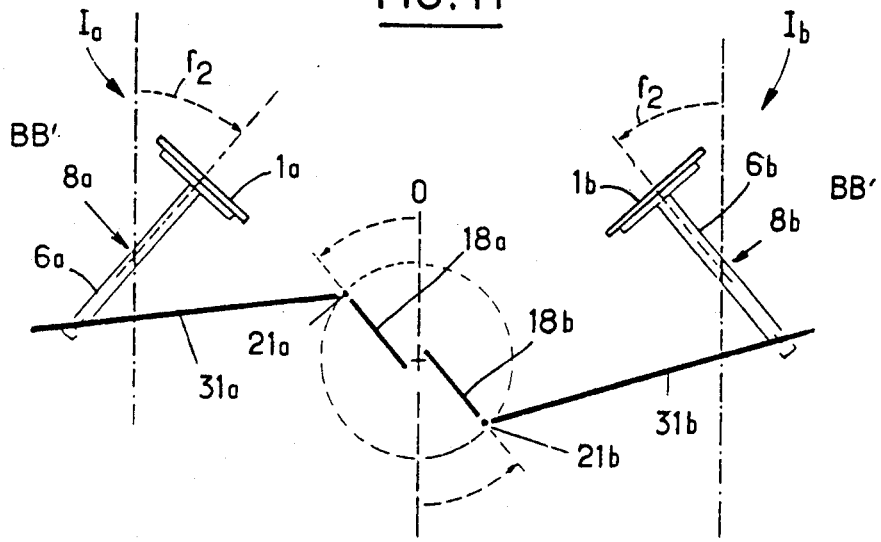
FIGS. 11, 12, 12*a*, 13, 14, 15, 15*a* and 16 are diagrams showing the typical positions of functioning of the apparatus.

In this state, the motor 14 may be supplied in order to drive the wheel 16 in rotation in the direction of arrow $f_1$ (FIG. 7) over a maximum angular amplitude, for example equal to 45°. This rotation rotates the box 17, which simultaneously produces the following effects:

(a) The connecting rods 31*a* and 31*b* push the beams outwardly with respect to the sagittal plane S. The beams pivot on axes B—B' in the direction of arrows $f_2$ (FIG. 11) entraining soles 1*a* and 1*b* in supination. The patient's feet are in this way urged in varus over a maximum angle of 45°.

Figure 12:
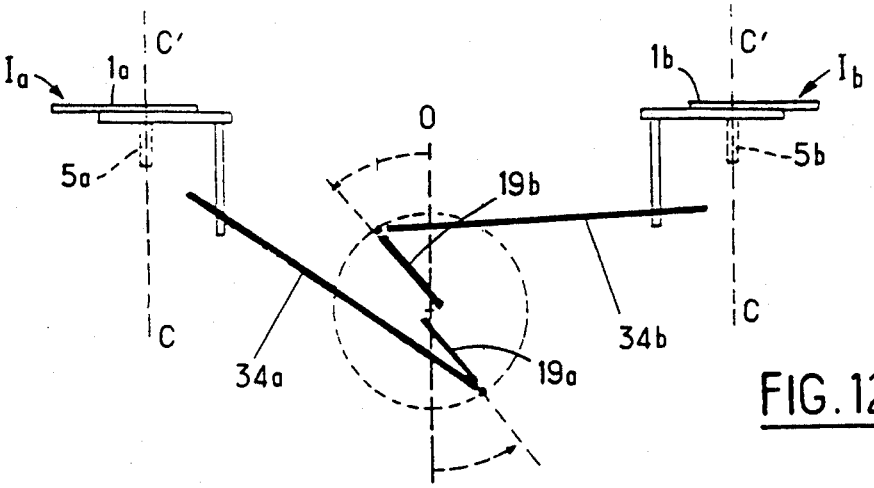
Figure 12A:
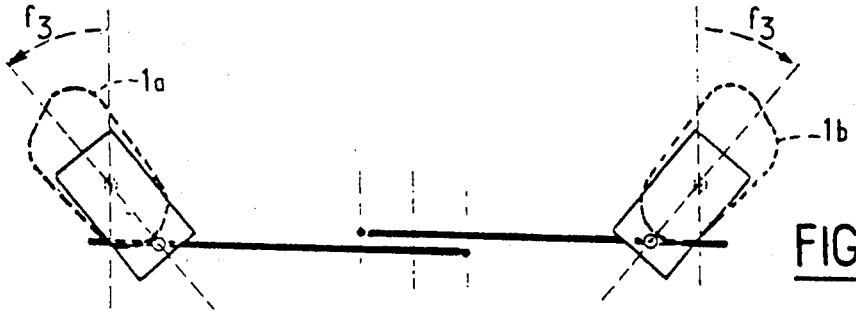

(b) The connecting rods 34*a*, 34*b* pull inwardly with respect to plane S the extensions 36*a* and 36*b* which cause the plates 3*a*, 3*b* to rotate on the pivots 5 materializing axes C—C'. The soles 1*a* and 1*b* are entrained in the direction of arrow $f_3$ (FIGS. 12 and 12*a*) in abduction by a maximum angular value of 45°.

Figure 13:
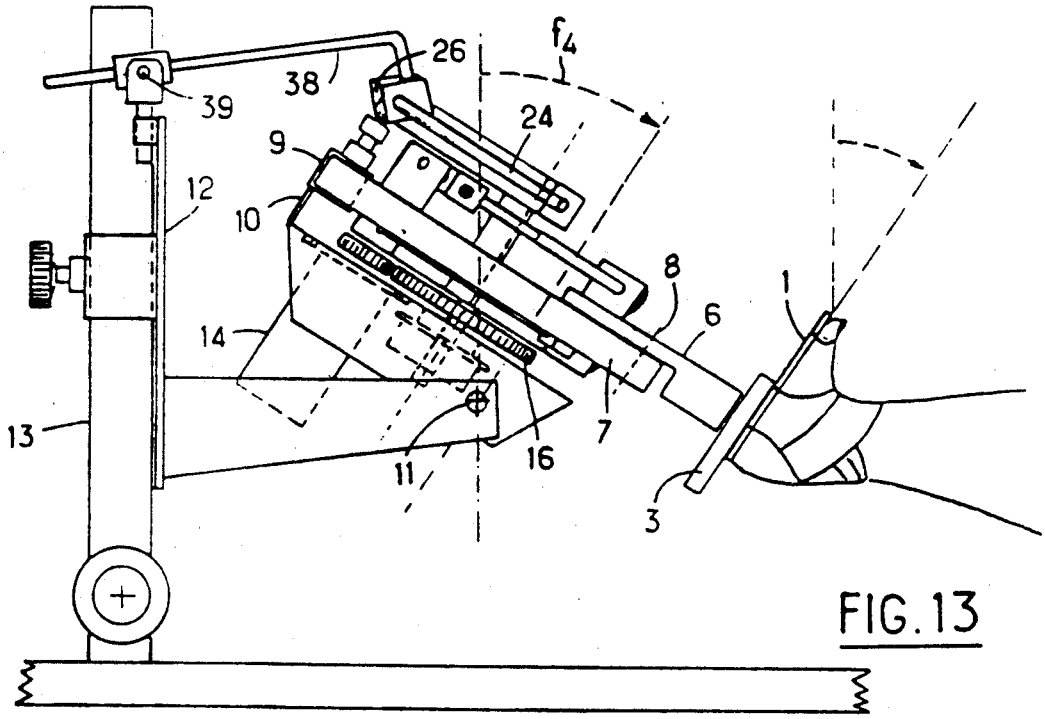

(c) The connecting rod 38, of fixed length, opposes rotation of box 17, which produces, in reaction, pivoting of cradle 10 on axis x—x' in the direction of arrow $f_4$ (FIG. 13). Soles 1*a* and 1*b* are simultaneously displaced downwardly and urge the feet in dorsal flexion over a maximum angular amplitude of 40°.

Figure 14:
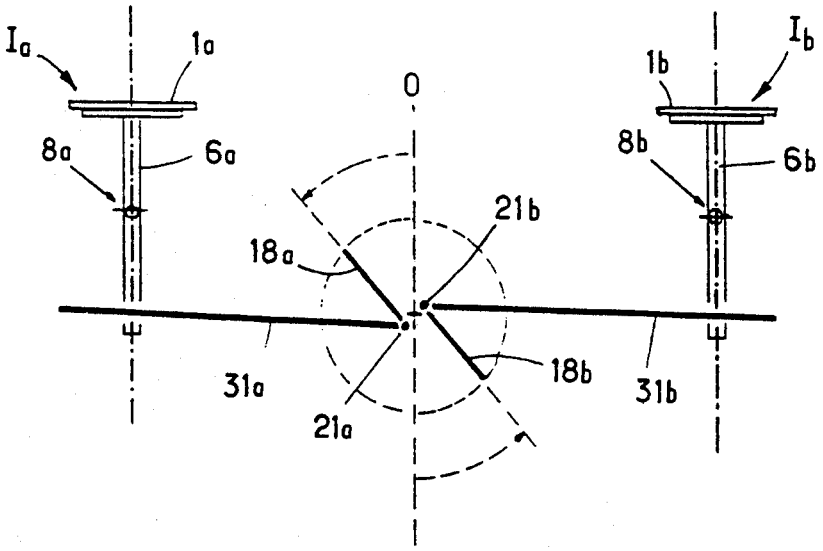
Figure 15:
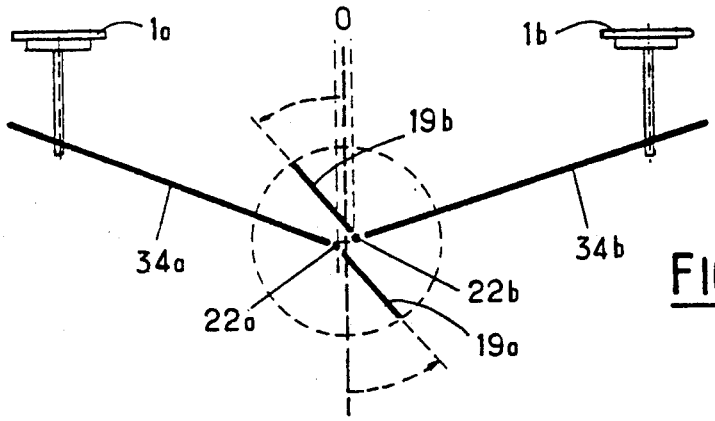
Figure 15A:
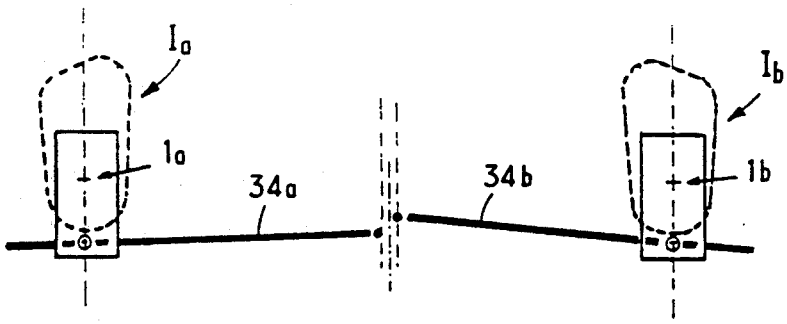
Figure 16:
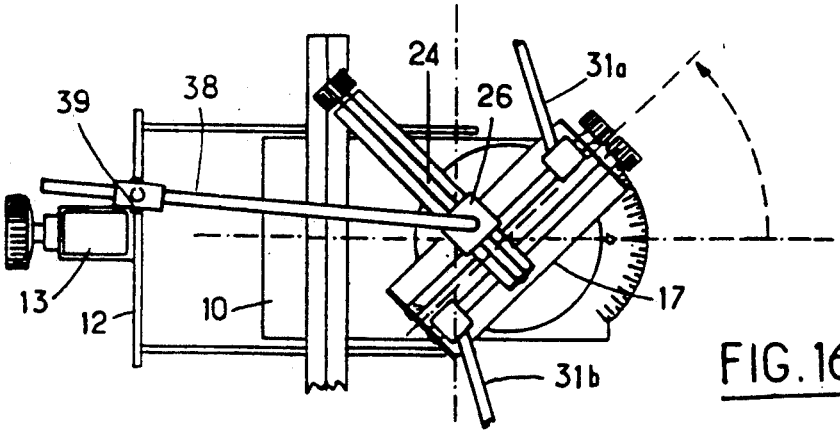

The slides 21*a*, 21*b*, 22*a*, 22*b* and 26 may be adjusted up to internal radial position, so as to vary the angular amplitude in supination (varus), abduction and flexion, from a maximum value to a zero value, as illustrated in FIG. 14 for supination, in FIGS. 15 and 15*a* for abduction and in FIG. 16 for flexion.

Movements inverse to those above, urging the feet in pronation (valgus), in adduction and in plantar flexion, intervene as soon as the supply of the motor 14 is inverted in order to rotate wheel 16 in the direction opposite that of arrow $f_1$ and return the box 17 into the neutral position according to FIG. 7.

It should be noted that it is possible to adjust the three movements independently, respecting the physiological and anatomical possibilities of the articulations of the foot, by acting separately on the knobs 20, so as to adjust the position of the slides 21, 22 and 26. It is also possible to deblock the pin 4 of each sole 1 when it is desired to resume a freedom of pivoting on axis A—A'.

Figure 18:
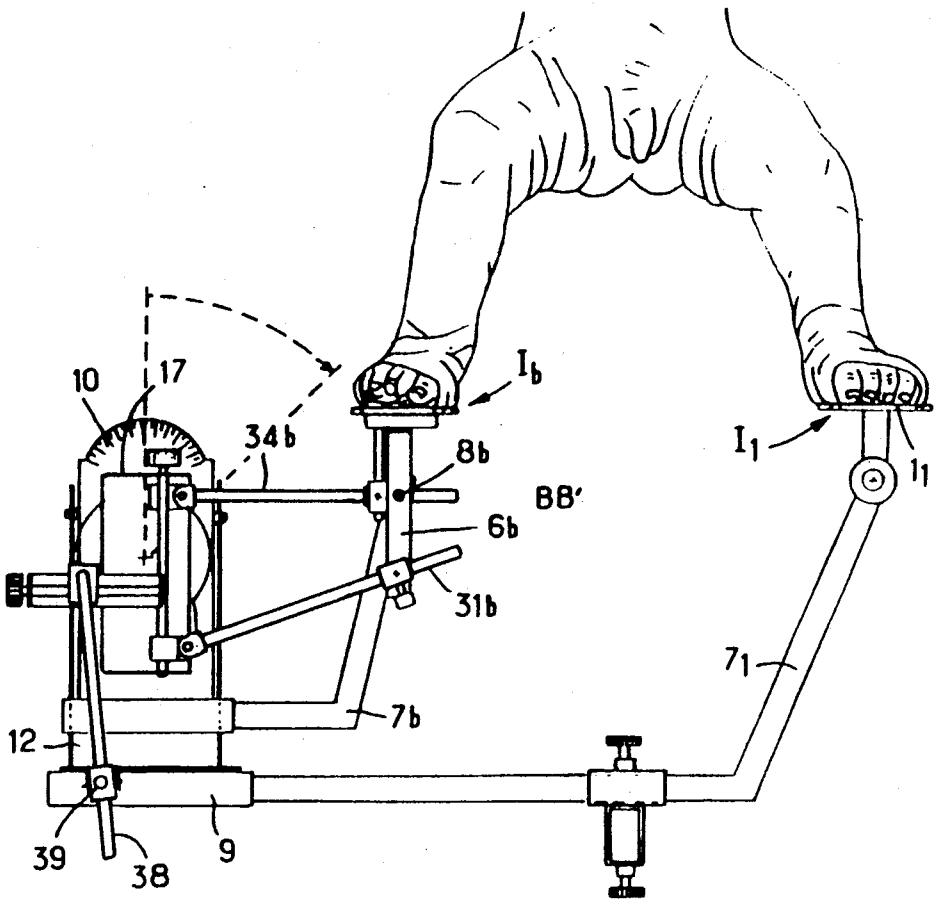
FIGS. 17 and 18 show two simplified variants of the apparatus.
Figure 17:
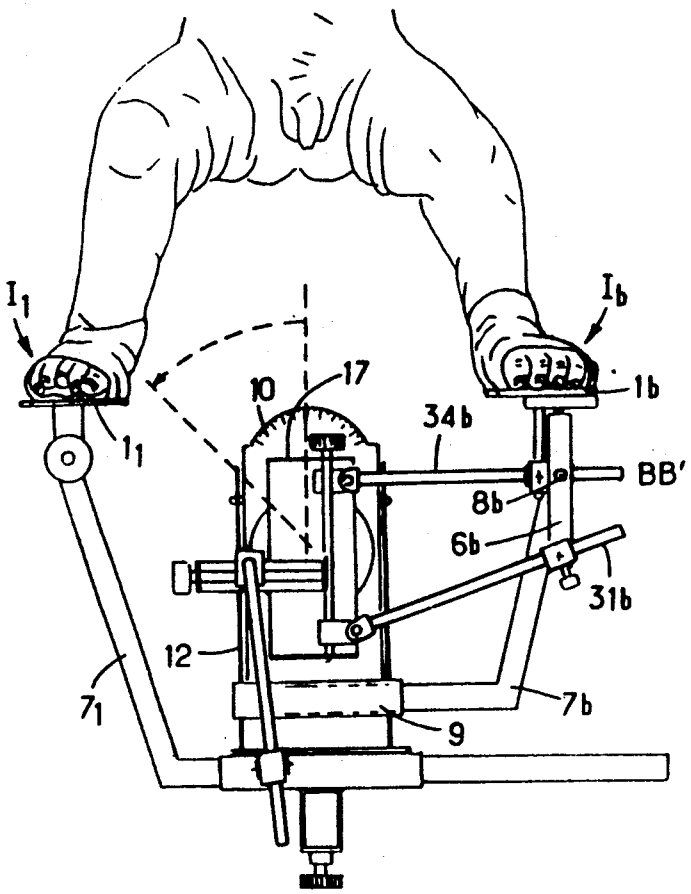

FIGS. 17 and 18 show a variant consisting in mounting on the box 17 only the operating system for one mobilization assembly, for example assembly 1*b* according to FIG. 17 for mobilizing the left foot. In such a case, the right foot may be fitted on a static assembly $\mathbf{1}_1$ comprising a fixed sole $\mathbf{1}_1$ mounted on an immobile arm $\mathbf{7}_1$ directly borne by the console 12. A variant structural construction is illustrated in FIG. 18 corresponding to the mobilization of the right foot. In this way, a mobilization of one foot may intervene with immobilization of the second in an overall posture respecting the symmetry and eliminating any natural, disorderly mobilization that the child might adopt for the free foot.

Figure 10:
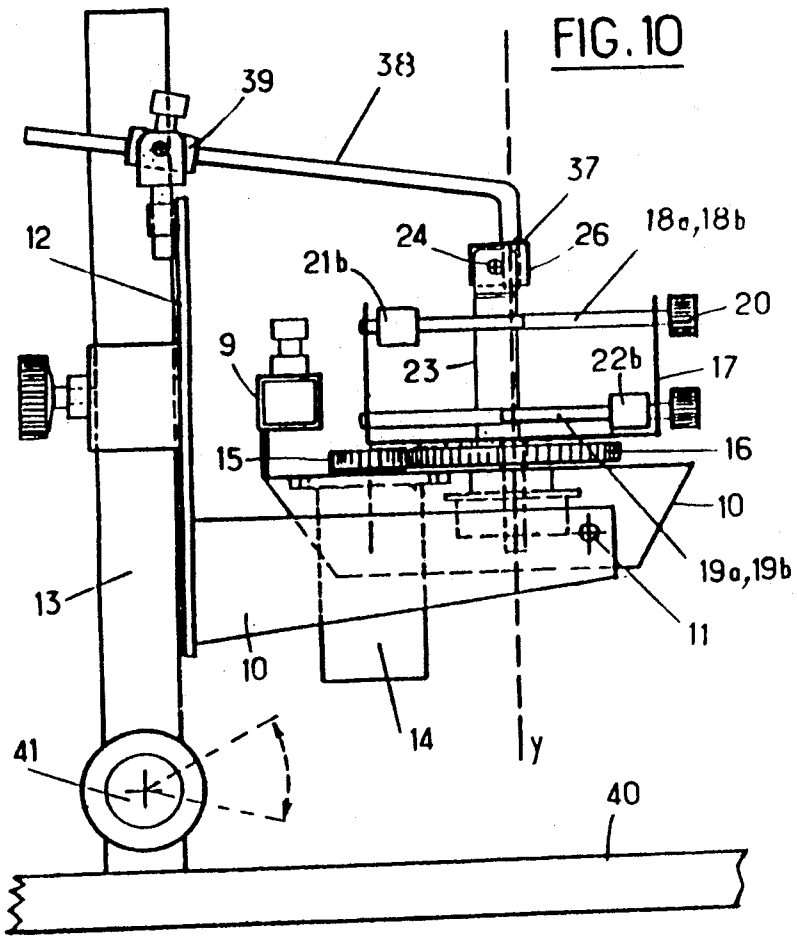
FIG. 10 is a transverse section taken along line X—X of FIG. 7.
Figure 8:
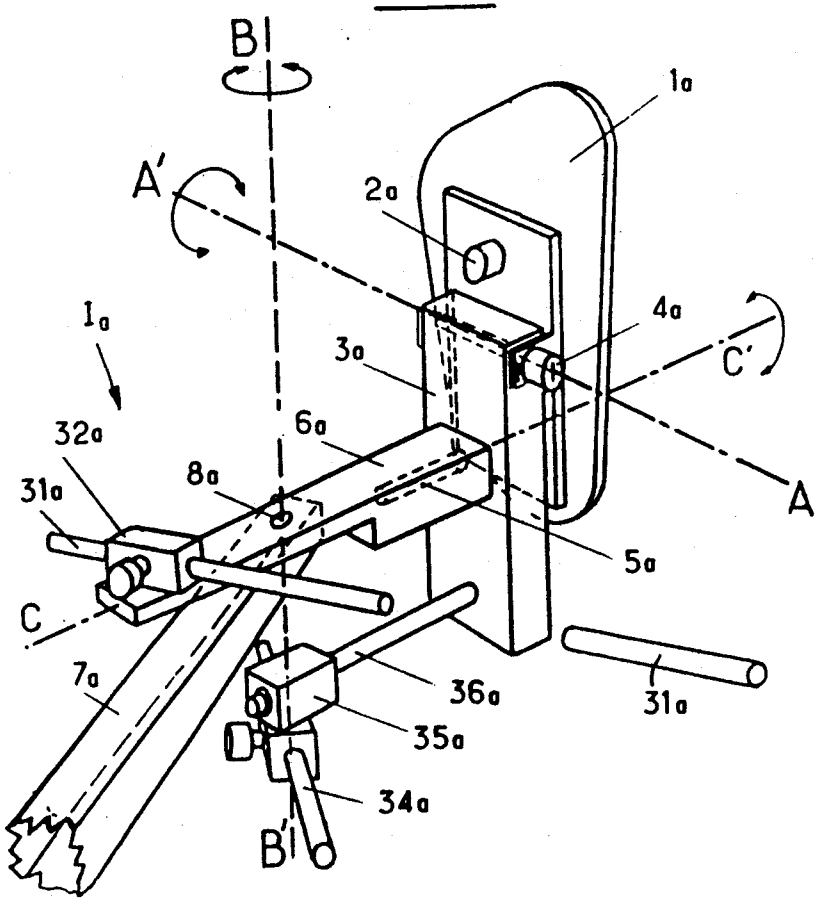
FIGS. 8 and 9 are partial perspective views showing, on a larger scale, details of embodiment of the apparatus.
Figure 9:
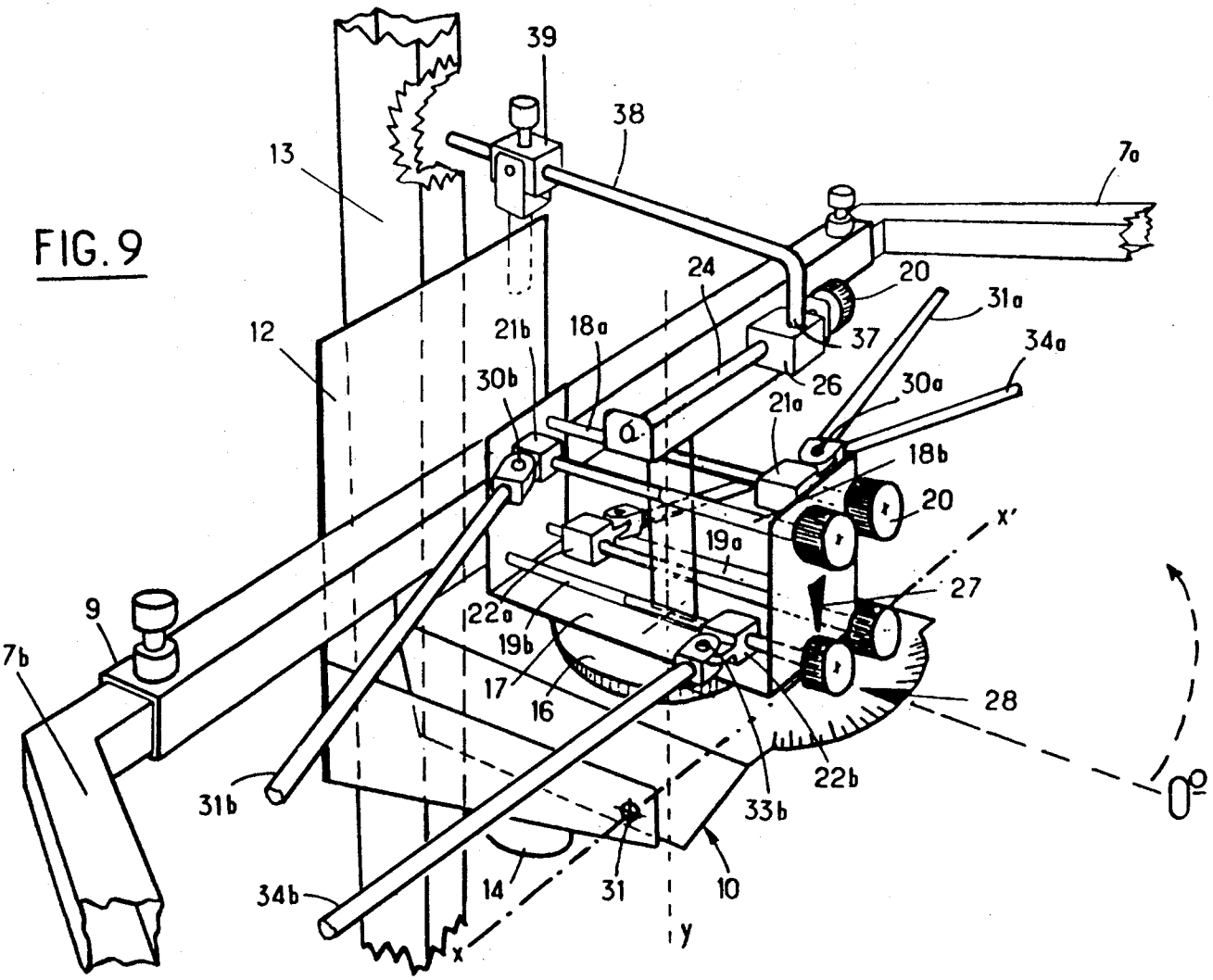

FIG. 10 shows that it may be advantageous to interpose, between the bracket 13 and a possible base 40, a notched articulation 41 making it possible to adjust the reference position of the console 12.

POSSIBILITY OF INDUSTRIAL APPLICATION

The apparatus finds a preferred application in the orthopaedic correction of the foot in a new-born baby.

The invention is not limited to the examples described and shown, as various modifications may be made thereto without departing from its scope.

I claim:

1. Apparatus for continuous passive articulatory mobilization of the foot of a new-born baby or child, said food defining three mutually perpendicular axes of articulation, including an axis of articulation in flexion, an axis of articulation in abduction-adduction, and an axis of articulation in supination-pronation, wherein said apparatus comprises:

a mobilization assembly, including:

means including a sole for receiving said foot;

means for mounting said sole on a first support to pivot around the axis of articulation in flexion and the axis of articulation in abduction-adduction;

means for mounting said first support on a second support to pivot around the axis of articulation in supination-pronation;

a support console;

a cradle; and means for mounting the cradle on the support console, wherein said first support comprises a plate mounted on the second support by an abduction-adduction pivot said plate including an extension, the second support includes a beam mounted on an arm to pivot around the supination-pronation axis of articulation, said arm extending laterally with respect to said cradle and being mounted to pivot with said cradle; and an operating system including:

a driving member mounted on the cradle and capable of being rotatably driven;

means for rotatably driving the driving member;

means including connecting rod members of adjustable length for connecting the cradle to at least said second support and said extension of the plate to convert rotary movement of said driving member into rectilinear movement of said connecting rod members, thereby causing pivotal movement of said second support and said extension around at least the respective abduction-adduction and supination-pronation axes; and means for adjusting the length of the connecting rod members in order to adjust amounts by which the second support and extension are pivoted in response to said rectilinear movement of said connecting rod members.

2. Apparatus as claimed in claim 1, further comprising means for mounting said cradle on said support console to pivot around an axis parallel to said axis of articulation in flexion, and means including a third rod member of adjustable length connected to said cradle and said console for opposing rotation of said cradle in a plane of rotation of said driving member and thereby causing said cradle to pivot about said parallel axis, in turn causing said sole to pivot about said axis of articulation in flexion.

3. Apparatus as claimed in claim 2, wherein said adjustment means comprises two threaded rods and means for mounting said two threaded rod in two stages on said cradle such that the threaded rods extend parallel to one another; a third threaded rod disposed orthogonally to the first two; and means for controlling the three threaded rods individually in rotation, each threaded rod including a tapped slide bearing to which a respective one of said three connecting rod members is connected.

4. Apparatus as claimed in claim 3, wherein said adjustment means further comprises adjustable blocks on the connecting rod members, said adjustable blocks being pivotally connected, respectively, to the second support, the extension, and the console.

5. Apparatus as claimed in claim 1, further comprising a static support assembly on which a second sole is fixedly mounted.

6. Apparatus as claimed in claim 1, further comprising a second said mobilization assembly disposed symmetrically with respect to a sagittal plane, said operating system cradle being common to both said mobilization assemblies.

7. Apparatus as claimed in claim 6, wherein said means for converting the rotary movement of the driving member into a reciprocating rectilinear movement of said connecting rod members includes means for converting the rotary movement of said driving member into a rectilinear movement of second connecting rod members connected to the second mobilization assembly, and wherein said apparatus further comprises means for mounting said cradle on said support console to pivot around an axis parallel to said axis of articulation in flexion; and means including a third connecting rod member of adjustable length connected to said cradle and said console for opposing rotation of said cradle in a plane of rotation of said driving member and thereby causing said cradle to pivot about said parallel axis, in turn causing said sole to pivot about said axis of articulation in flexion.

8. Apparatus as claimed in claim 7, wherein said adjustment means comprises:

a support mounted for rotation with the driving member;

two pairs of threaded rods extending parallel to one another in two stages borne by the support and also disposed on either side of an axis of rotation of the driving member;

tapped slides disposed in opposition on either side of the axis of rotation for those of the same pair of threaded rods and symmetrically inverse from one pair of threaded rods to the other;

a third threaded rod extending orthogonally relative to the two pairs and provided with its own slide, said two pairs of connecting rod members articulated on the tapped slides; and means for adjustable connection between the third connecting rod member and the console, between the connecting rod members of a first pair of rod members and extensions of respective first sole supports of the two assemblies, and between the connecting rods of a second pair of rod members and second sole supports of the two assemblies.

9. Apparatus as claimed in claim 8, wherein the adjustable connecting means comprises blocks adjustably mounted on the connecting rod members and borne in articulated manner by the console, the first support, and the second supports.

10. Apparatus as claimed in claim 1, wherein said driving member and means for rotatably driving said driving member form an electric motor mounted on the cradle and including a driven shaft which bears a toothed pinion meshing with a toothed wheel mounted on the cradle and bearing a support for said rod members, said support being centered on an axis of rotation of the toothed wheel.

* * * * *